United States Patent [19]

Walker, Jr. et al.

[11] 4,120,701

[45] Oct. 17, 1978

[54] REACTANT FOR STEEL

[75] Inventors: Clarence H. Walker, Jr., Phoenix, Ariz.; William B. Steward, Jr., Haddon Heights, N.J.

[73] Assignee: The United States of America as represented by the Secretary of the Army, Washington, D.C.

[21] Appl. No.: 576,178

[22] Filed: Aug. 25, 1966

[51] Int. Cl.[2] ..... C22F 3/00; C22C 7/00

[52] U.S. Cl. ..... 148/4; 29/413; 75/134 A; 75/134 T; 75/169; 148/22; 225/2

[58] Field of Search ..... 148/22, 4, 6, 6.27; 83/1; 156/18; 117/130; 75/169, 134 T, 134 A; 225/2; 29/413

[56] References Cited

U.S. PATENT DOCUMENTS

| | | | |
|---|---|---|---|
| 3,054,938 | 9/1962 | Meddick | 102/24 |
| 3,135,205 | 6/1964 | Zwicky | 102/24 |
| 3,254,996 | 6/1966 | MacDonald | 75/206 |
| 3,969,154 | 7/1976 | Collins et al. | 225/2 X |
| 4,045,356 | 8/1977 | Eisner et al. | 75/169 X |

*Primary Examiner*—Richard E. Schafer

*Attorney, Agent, or Firm*—Nathan Edelberg; Harold H. Card, Jr.; A. Victor Erkkila

[57] ABSTRACT

New reactants for catastrophically embrittling steel having a hardness of Rockwell C40 or greater comprising an amalgam of 98 to 99 weight percent mercury, the balance being lithium and indium; and sulfuric acid, and methods for applying said reactants to the steel.

6 Claims, 2 Drawing Figures

Figure 1:
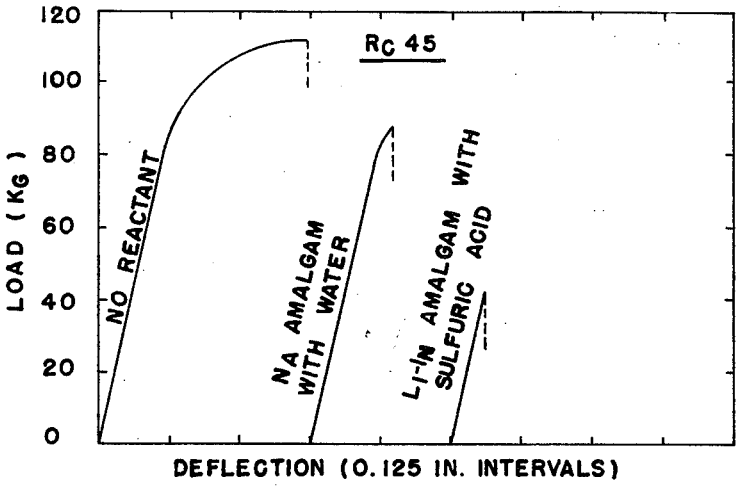

FIG. 1.

INVENTOR.
CLARENCE H. WALKER, JR.
WILLIAM B. STEWARD, JR.
BY Harry M. Saragovitz, Edward J. Kelly, Herbert Berl & S. Dubroff
ATTORNEYS:

REACTANT FOR STEEL

This invention relates to reactants for treating steels to diminish the strength and ductility thereof, and particularly to reactants for treating steels having hardnesses of Rockwell C40 or greater to cause catastrophic embrittlement thereof.

A problem which has been encountered in ballistic application of the liquid metal embrittlement effect is that reactants, or embrittling agents, now available are limited, with regard to steels, in their capability for causing complete brittle failure thereof or what is commonly known as catastrophic embrittlement. This limitation stems from the fact that the severity of the embrittling effect is related to the strength or hardness of the steel being attached. Generally, as the strength or hardness of the steel decreases, the embrittling effect decreases. Because of this current reactants used are only capable of embrittling steels of hardness Rockwell C45 and above. This means that steels harder than Rockwell C45 can be made to fail below their normal yield strength by these current reactants, while steels of hardness lower than Rockwell C45 cannot be thus embrittled.

It is therefore an object of the present invention to provide a reactant which will cause catastrophic embrittlement of steels having hardnesses of Rockwell C40 or greater. Another object of the present invention is to provide a reactant of the type described which will cause the embrittlement at room temperature conditions. It is still an object of the present invention to provide a reactant of the type described which is pasty in substance at room temperature. Still another object of the present invention is to provide a reactant of the type described which may be used together with a projectile to defeat steel armor plate. Further objects and advantages of the present invention will become apparent to those skilled in the art from the following discussion and appended claims.

In accordance with the present invention the above objects are accomplished by a reactant consisting of a liquid metal portion, or what is commonly called an amalgam, of mercury, indium, and lithium; and a small amount of concentrated sulfuric acid. When steel is treated with the reactant of the present invention a considerable diminishing of strength and ductility results. Moreover, when steels having hardnesses of Rockwell C40 or greater are treated with this reactant catastrophic embrittlement results. Catastrophic embrittlement occurs when a metal is caused to fail below its yield strength. This means, in essence, that the metal has been made brittle and will not take a permanent or plastic deformation.

The composition and their ranges of the amalgam portion of the inventive reactant in weight percentages are as follows:

Mercury: 98 to 99
Indium: 0.25 to 0.75
Lithium: 0.75 to 1.25

The above amalgams are made according to the following procedure using mercury, solid indium and solid lithium. Appropriate amounts of small indium chips are dissolved into the mercury. After the mercury and indium are well mixed small chips of solid lithium, in the correct amount, are added. Upon dissolution of the lithium chips into the mercury indium amalgam, the reactant is ready for use. When the indium is added to the mercury before the lithium, the lithium appears to dissolve more rapidly. Dissolution of the lithium into the mercury-indium amalgam can be hastened by mild heating, but it is not necessary. In appearance the mercury-indium lithium amalgam is a silvery paste.

Concentrated sulfuric acid in a small amount is added to the liquid metal or amalgam portion. The quantity of acid necessary can be as little as two drops per 1 gram of amalgam. The combination of the amalgam and the acid form the inventive reactant. The acid, however, must be kept separated from the amalgam until an application is made to a steel sample or a steel target. Dilution of the sulfuric acid noticeably diminshes the effectiveness of the reactant. Therefore, in order to obtain the greatest embrittlement effect, concentrated sulfuric acid is necessary.

The reason for the increased embrittlement caused by the inventive reactant is not known for certain. It is believed that the sulfuric acid assists in causing the amalgam portion to wet the steel.

Figure 2:
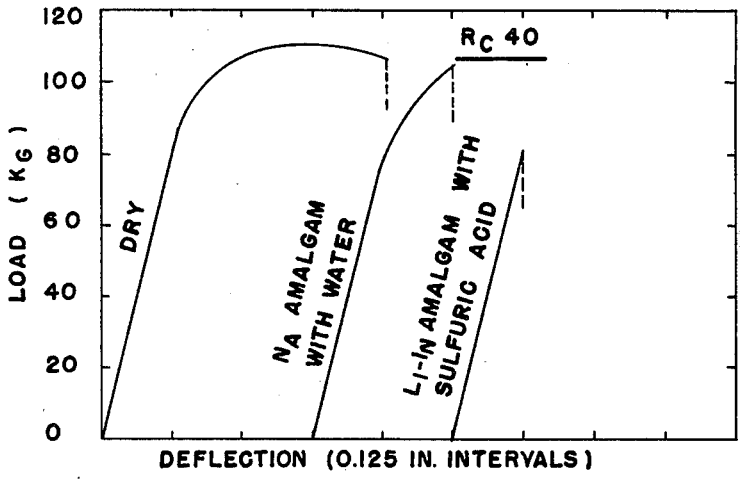

Samples of steel were treated with a reactant of the present invention consisting of an amalgam of mercury in an amount of 98.5 weight percent, lithium in an amount of 1.0 weight percent, and indium in an amount of 0.5 weight percent, together with a small amount of concentrated sulfuric acid intimately commingled with the amalgam. A similar steel sample was treated with a reactant consisting of an amalgam of mercury in an amount of 98 weight percent and sodium in an amount of 2 weight percent, together with a small amount of water intimately commingled with the amalgam. The treated samples were compared with an untreated sample. The increased effect of the reactant of the present invention is shown in FIGS. 1 and 2 which are load-deflection curves depicting the embrittling occurring on a steel sample loaded in bending. FIG. 1 shows the comparative results obtained from wetting steel of a hardness of Rockwell C45 with the sodium and inventive reactants. FIG. 2 shows comparative results of similar tests on steel samples of a hardness of Rockwell C40. It can be readily seen that the inventive reactant causes failure, in each instance, at less deflection than that required with the sodium reactant. The inventive reactant produced a 62 percent reduction in load on Rockwell C45 steel as compared to 30 percent reduction in load by the sodium reactant. Furthermore, the inventive reactant applied to steel of hardness Rockwell C40 produced a 28 percent reduction in load and a 70 percent reduction in deflection-to-failure. This is a substantial improvement over the sodium reactant which produced only a 7 percent reduction in load and a 50 percent reduction in deflection-to-failure on steel of identical hardness.

Various modifications and alterations of this invention will become apparent to those skilled in this art without departing from the scope and spirit of this invention, and the foregoing discussion should not be construed to unduly limit this invention.

We claim:

1. A method for diminishing the strength and ductility of steel comprising contacting said steel with a lithium-indium amalgam containing a small amount of sulfuric acid.

2. A method according to claim 1 wherein the contents of lithium and indium are about 0.75 to 1.25 weight percent and about 0.25 to 0.75 weight percent, respectively.

3. A method according to claim 1 wherein the contents of lithium and indium are about 1.0 weight percent and 0.5 weight percent, respectively.

4. A method according to claim 1 wherein said steel has a hardness at least about Rockwell C40.

5. A reactant for diminishing the strength and ductility of steel consisting essentially of an amalgam containing about 0.75 to 1.25 weight percent lithium, about 0.25 to 0.75 weight percent indium, and a small amount of sulfuric acid.

6. A reactant according to claim 5 wherein the mercury content of said amalgam is about 98 to 99 weight percent.

* * * * *